US010165806B2

(12) United States Patent
Duncan et al.

(10) Patent No.: US 10,165,806 B2
(45) **Date of Patent: *Jan. 1, 2019**

(54) SYSTEMS FOR ACTIVE COUPLING OF AIRBAGS

(71) Applicant: Elwha LLC, Bellevue, WA (US)

(72) Inventors: William D. Duncan, Sammamish, WA (US); Roderick A. Hyde, Redmond, WA (US); Yaroslav A. Urzhumov, Bellevue, WA (US)

(73) Assignee: Elwha LLC, Bellevue, WA (US)

( * ) Notice: Subject to any disclaimer, the term of this patent is extended or adjusted under 35 U.S.C. 154(b) by 113 days.

This patent is subject to a terminal disclaimer.

(21) Appl. No.: 15/424,004

(22) Filed: Feb. 3, 2017

(65) Prior Publication Data

US 2017/0143055 A1 May 25, 2017

Related U.S. Application Data

(63) Continuation of application No. 14/528,717, filed on Oct. 30, 2014, now Pat. No. 9,648,914.

(51) Int. Cl.

| | |
|---|---|
| ***A41D 13/015*** | (2006.01) |
| ***A41D 13/018*** | (2006.01) |
| ***A42B 3/04*** | (2006.01) |
| ***A63B 71/12*** | (2006.01) |
| ***A63B 71/10*** | (2006.01) |
| ***A41D 13/05*** | (2006.01) |
| ***A63B 71/08*** | (2006.01) |
| *A63B 102/24* | (2015.01) |

(52) U.S. Cl.

CPC ..... *A41D 13/018* (2013.01); *A41D 13/0512* (2013.01); *A42B 3/0486* (2013.01); *A63B 71/081* (2013.01); *A63B 71/10* (2013.01); *A63B 71/12* (2013.01); *A63B 71/1291* (2013.01); *A63B 2071/1208* (2013.01); *A63B 2102/24* (2015.10); *A63B 2209/08* (2013.01); *A63B 2209/10* (2013.01); *A63B 2220/53* (2013.01); *A63B 2225/50* (2013.01); *A63B 2243/007* (2013.01)

(58) Field of Classification Search

CPC .. A41D 13/018; A63B 71/10; A63B 71/1291; A42B 3/0486

See application file for complete search history.

(56) References Cited

U.S. PATENT DOCUMENTS

| | | | |
|---|---|---|---|
| 5,133,084 | A | 7/1992 | Martin |
| 5,287,562 | A | 2/1994 | Rush |
| 5,313,670 | A | 5/1994 | Archer |
| 5,390,367 | A | 2/1995 | Rush |
| 5,402,535 | A | 4/1995 | Green |
| 5,546,609 | A | 8/1996 | Rush |
| 5,781,936 | A | 7/1998 | Alaloof |
| 6,032,299 | A | 3/2000 | Welsh |
| 6,418,564 | B1 | 7/2002 | Sheridan |

(Continued)

*Primary Examiner* — Khaled Annis

(74) *Attorney, Agent, or Firm* — Foley & Lardner LLP

(57) ABSTRACT

An airbag deployment system includes a helmet, a torso protection assembly, and an airbag assembly. The airbag assembly is coupled to one of the helmet and the torso protection assembly and includes an airbag, an inflation device configured to inflate the airbag, and a first coupling device. The first coupling device is configured to couple to a second coupling device provided on the other of the helmet and the torso protection assembly upon inflation of the airbag. The coupling resists relative movement between the helmet and the torso protection assembly.

35 Claims, 10 Drawing Sheets

(56) References Cited

U.S. PATENT DOCUMENTS

| | | | |
|---|---|---|---|
| 6,729,643 | B1 | 5/2004 | Bassick et al. |
| 7,017,195 | B2 | 3/2006 | Buckman et al. |
| 7,703,152 | B2 | 4/2010 | Rhodes et al. |
| 7,849,525 | B2 | 12/2010 | Ghajar |
| 7,926,839 | B1 | 4/2011 | Mothaffar |
| 8,023,676 | B2 | 9/2011 | Abolfathi et al. |
| 8,270,638 | B2 | 9/2012 | Abolfathi et al. |
| 2002/0100109 | A1 | 8/2002 | Hoop |
| 2004/0183283 | A1 | 9/2004 | Buckman et al. |
| 2006/0260027 | A1 | 11/2006 | Rhodes et al. |
| 2009/0064396 | A1 | 3/2009 | Ghajar |
| 2009/0158509 | A1 | 6/2009 | Ghajar |
| 2009/0220921 | A1 | 9/2009 | Abolfathi et al. |
| 2010/0098269 | A1 | 4/2010 | Abolfathi et al. |
| 2010/0098270 | A1 | 4/2010 | Abolfathi et al. |
| 2012/0142270 | A1 | 6/2012 | Abolfathi et al. |
| 2012/0195446 | A9 | 8/2012 | Abolfathi et al. |
| 2013/0044903 | A1 | 2/2013 | Abolfathi et al. |
| 2013/0296755 | A1 | 11/2013 | Duncan et al. |

SYSTEMS FOR ACTIVE COUPLING OF AIRBAGS

CROSS-REFERENCE TO RELATED APPLICATIONS

This application is a continuation of U.S. patent application Ser. No. 14/528,717, filed Oct. 30, 2014, which is incorporated herein by reference in its entirety.

BACKGROUND

Various systems are used in applications, such as sports, motor vehicle operation, and the like, to help reduce injuries. For example, football players typically wear a football helmet and shoulder pads to minimize the risk of injury (e.g., due to collisions with other players, the ground, etc.) while playing. Similarly, motor vehicle operators such as motorcyclists often wear helmets to minimize the risk of injury (e.g., due to collisions with other motor vehicles, etc.) while driving.

SUMMARY

One embodiment relates to an airbag deployment system, including a helmet; a torso protection assembly; and an airbag assembly coupled to at least one of the helmet and the torso protection assembly and including an airbag, an inflation device configured to inflate the airbag, and a first coupling device. The first coupling device is configured to couple to a second coupling device provided on the other of the helmet and the torso protection assembly upon contact between the first and second coupling devices following inflation of the airbag and resist relative movement between the helmet and the torso protection assembly.

Another embodiment relates to an airbag deployment system, including a helmet having an airbag; an inflation device configured to inflate the airbag; and a first coupling device. The system further includes a torso protection assembly including a second coupling device configured to couple with the first coupling device upon contact between the first and second coupling devices following inflation of the airbag to resist relative movement between the helmet and the torso protection assembly.

Another embodiment relates to an airbag deployment system, including a helmet having an airbag; an inflation device configured to inflate the airbag; a processing circuit configured to control operation of the inflation device; and a first coupling device. The system further includes a torso protection assembly including a second coupling device configured to couple with the first coupling device upon contact between the first and second coupling devices and following inflation of the airbag to resist relative movement between the helmet and the torso protection assembly.

Another embodiment relates to a method of inflating an airbag of an airbag deployment system. The method includes receiving impact data regarding at least one of an actual and an expected impact, and inflating an airbag based on the impact data to couple a helmet to a torso protection device and resist relative movement between the helmet and the torso protection device.

Another embodiment relates to a method of inflating an airbag of an airbag deployment system. The method includes receiving impact data regarding at least one of an actual and an expected impact, and inflating an airbag from a helmet based on the impact data to couple the helmet to a torso protection device and resist relative movement between the helmet and the torso protection device, wherein the airbag includes a first coupling device configured to couple to a second coupling device provided on the torso protection device, wherein the first and second coupling devices form a joint configured to fail upon a joint parameter exceeding a predetermined threshold.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
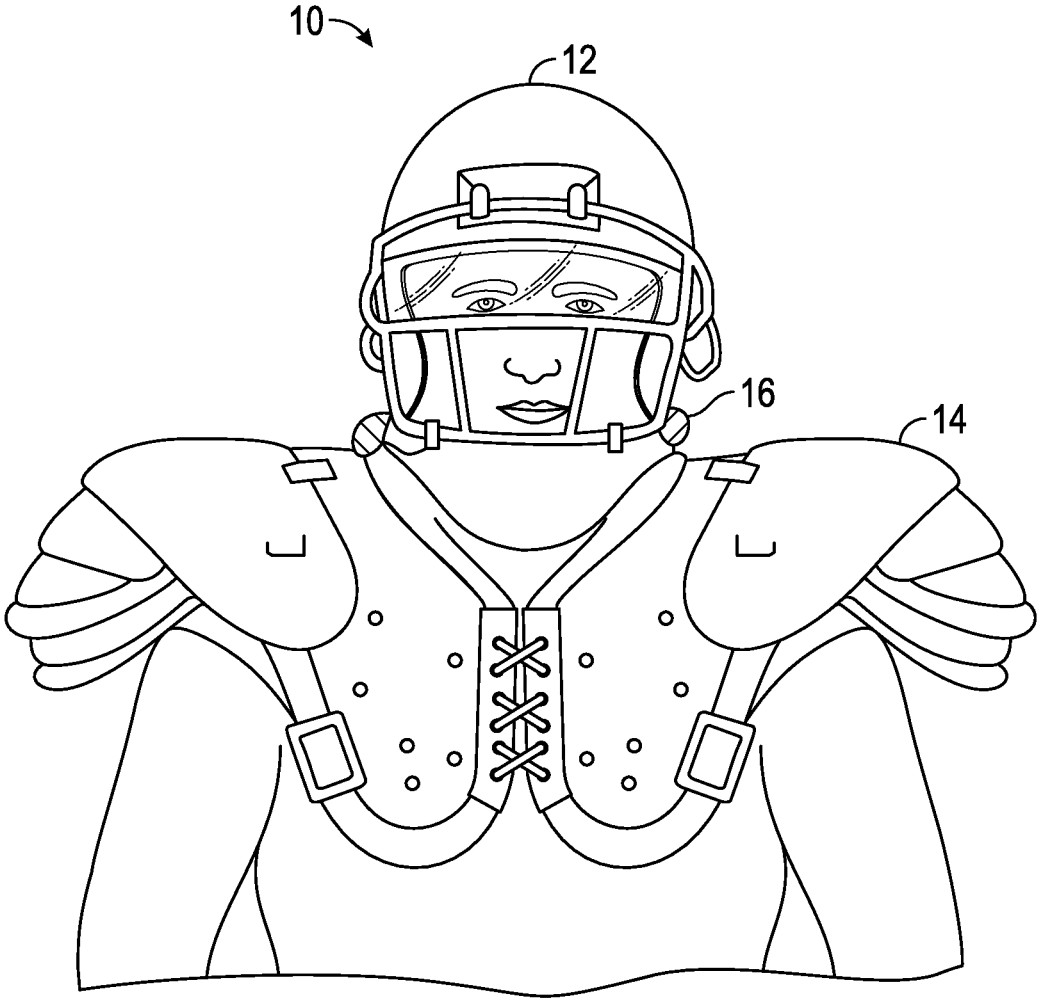
FIG. 1 is a front view of a helmet and torso protection assembly worn by a user according to one embodiment.

In the following detailed description, reference is made to the accompanying drawings, which form a part thereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Referring to the figures generally, various embodiments disclosed herein relate to airbag deployment systems for users such as athletes, motor vehicle operators, and the like. The airbag deployment system generally includes a helmet (e.g., a head protection assembly such as a football helmet, hockey helmet, motorcycle helmet, etc.) and a torso protection assembly (e.g., football shoulder pads, a torso or shoulder member, etc.). Upon occurrence of a triggering event, such as detection of a potential or actual impact, an airbag is inflated and couples the helmet to the torso protection assembly. In some embodiments, deployment and inflation of an airbag occur together (e.g., the act of inflation deploys the airbag from the structure to which it is mounted or attached). In other embodiments, deployment occurs independently from inflation (e.g., a cover is first removed from the airbag, after which it is later inflated). In some embodiments, the airbag prevents or resists relative movement between the helmet and the torso protection assembly to, among other things, minimize accelerations experienced by the head and neck portions of the user and reduce the risk of the user experiencing a concussion or other undesirable injuries.

Referring now to FIGS. 1-5, airbag deployment system 10 is shown according to one embodiment. System 10 is usable to reduce the risk of injury to users while performing various activities, including playing sports (e.g., football, hockey, etc.) and/or operating motor vehicles (e.g., motorcycles, ATVs, etc.). As shown in FIG. 1, system 10 includes helmet 12 (e.g., a head protection device or member, a first or upper protection device or member, etc.) and torso protection assembly 14 (e.g., a shoulder pad assembly, a second or lower protection device or assembly, etc.). System 10 further includes helmet airbag assembly 16. As discussed in greater detail herein, system 10 is configured to resist relative movement between helmet 12 and torso protection assembly 14 in cases of impacts or collisions involving the user of system 10 (e.g., such as collisions between players during a sporting activity, collisions between a motor vehicle occupant and other motor vehicles or operators, etc.).

Figure 2:
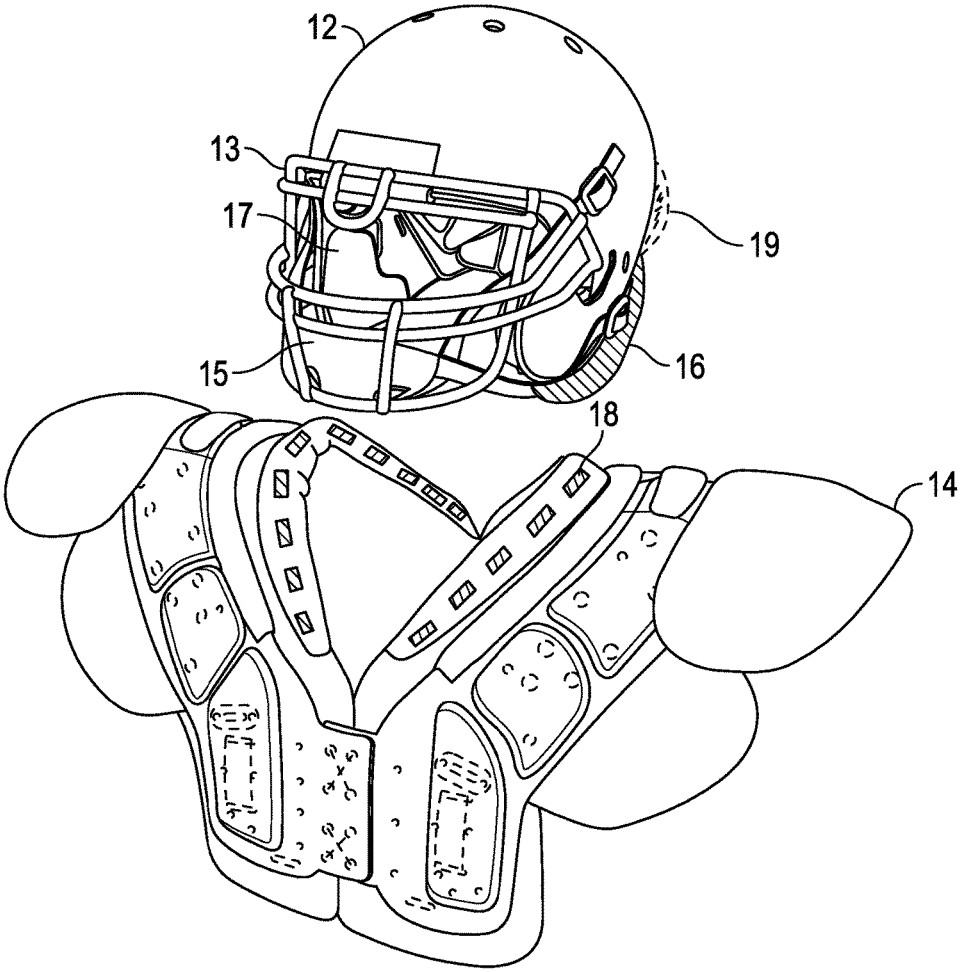
FIG. 2 is a perspective view of a helmet embodying an airbag assembly and a torso protection assembly prior to airbag deployment according to one embodiment.

Referring to FIG. 2, in one embodiment helmet 12 includes facemask 13, chin strap 15, helmet airbag assembly 16, helmet padding 17, and inflation device 19. Facemask 13 may be any type of helmet facemask to protect the user's face. In some embodiments, facemask 13 may include one or more crossbars, a transparent shield, or other protection devices. In yet further embodiments, facemask 13 is omitted. Chin strap 15 may be any type of helmet chin strap configured to secure helmet 12 to the user's head (e.g., by extending under or near the chin, on a portion of the neck, etc.), including a football helmet chin strap and the like. Helmet padding 17 may be any type of helmet padding for added head protection to the user (e.g., foam padding, inflatable pads, etc.).

Torso protection assembly 14 includes torso protection assembly connector 18 (e.g., a coupling device). Torso protection assembly connector 18 is one or more devices (e.g., hook and loop fasteners, magnets, quick drying adhesive, etc.) embedded in or coupled to the collar portion of torso protection assembly 14 for coupling helmet 12 and torso protection assembly 14 by means of helmet airbag assembly 16. Inflation device 19 may be implemented to inflate helmet airbag assembly 16 by means of a chemical reaction to produce gas, or alternatively may involve the storage and release of compressed gas.

Figure 3:
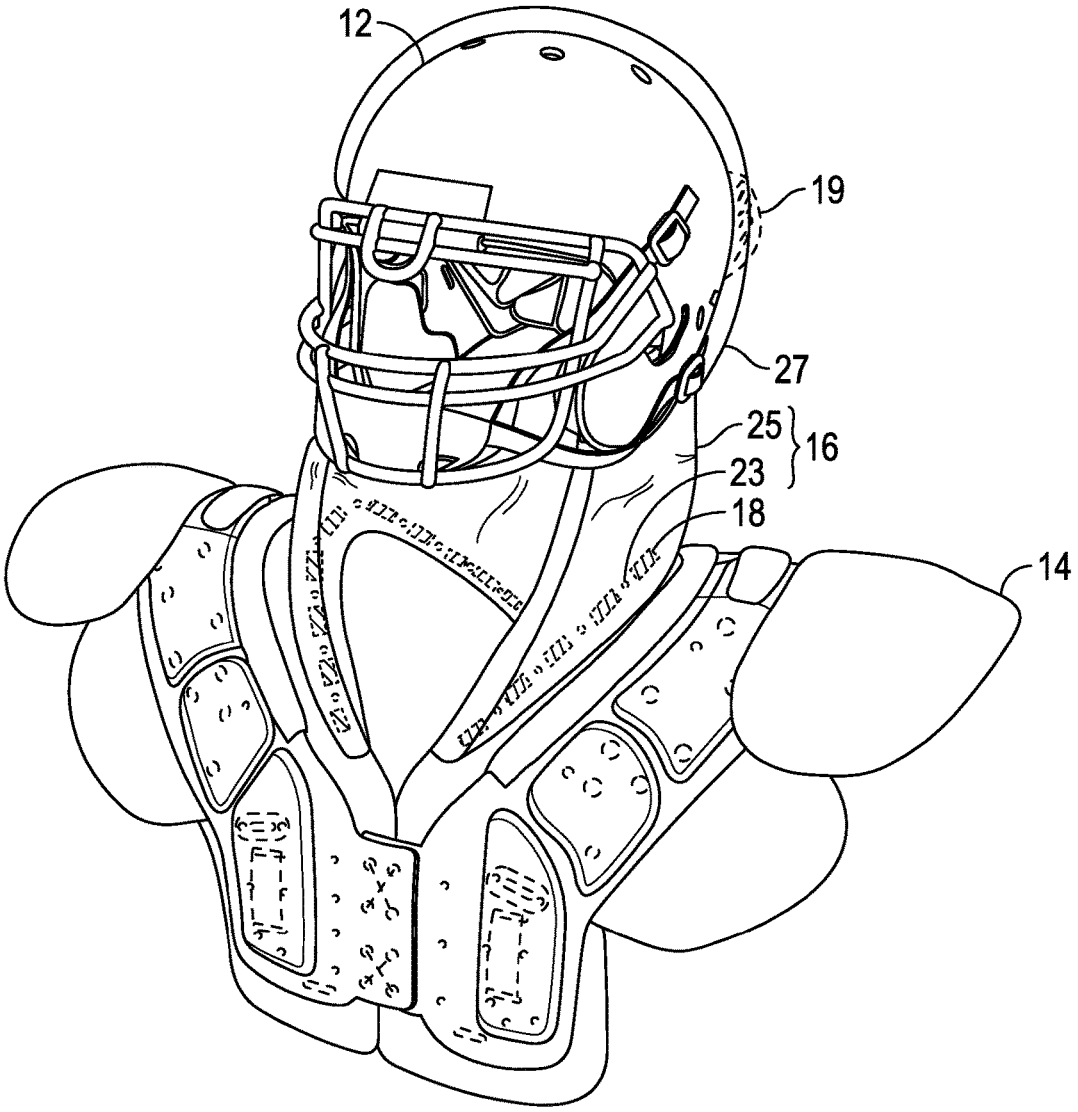
FIG. 3 is a perspective view of the helmet and torso protection assembly of FIG. 1 after airbag deployment from the helmet and connection to the torso protection assembly according to one embodiment.

Referring now to FIG. 3, the active coupling between helmet 12 and torso protection assembly 14 is shown for one embodiment. Helmet airbag assembly 16 includes airbag 25 and airbag connector 23 (e.g., a first coupling device). Airbag connector 23 may be one or more devices (e.g., hook and loop fasteners, magnets, quick drying adhesive, etc.) which actively couples to torso protection assembly connector 18 to resist relative movement between helmet 12 and torso protection assembly 14 to reduce risk of injury to the user of system 10. In one embodiment, helmet airbag assembly 16 further includes radial airbag 27 configured to inflate radially around helmet 12 (e.g., to cover all or a portion of helmet 12) to reduce the magnitude of the impact to the user's head (e.g., by increasing the duration of the collision). In other embodiments, radial airbag 27 is omitted.

Figure 4:
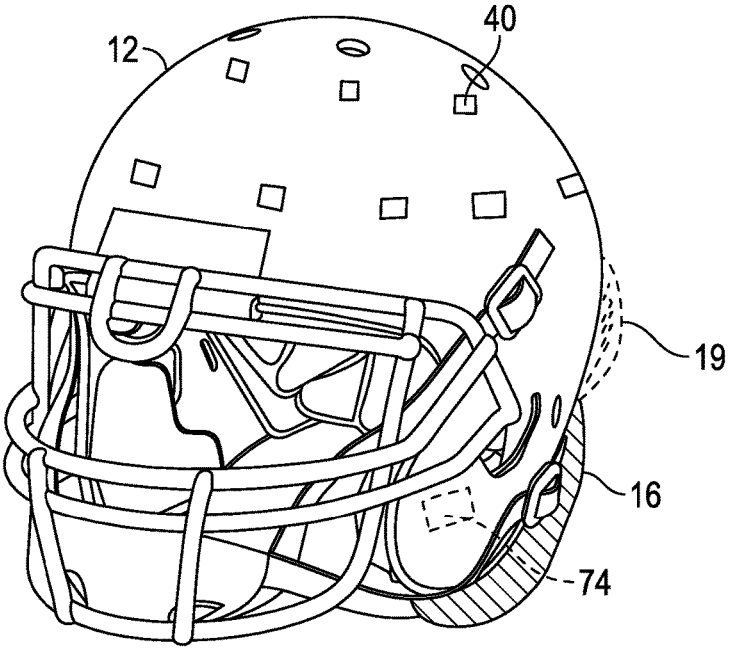
FIG. 4 is a perspective view of a helmet usable with a personal protection system according to one embodiment.

Referring to FIG. 4, one embodiment of helmet 12 is shown. The configuration of helmet 12 shown includes processing circuit 74, sensor 40, helmet airbag assembly 16, and inflation device 19. Sensor 40 may be one or more devices configured to measure at least one of an expected time until an impact, a speed of an impacting body, the size of an impacting body, and a distance between impacting bodies to define an expected impact parameter. In one embodiment, sensor 40 is implemented as a micropower impulse radar (MIR). In other embodiments, sensor 40 is configured to measure at least one of a force, a torque, and an acceleration (e.g., of the helmet during impact, of an approaching object or person before or during impact, relative acceleration(s), etc.) to define one or more actual impact parameters. In an embodiment, sensor 40 can include one or more accelerometers, pressure sensors, or the like. In one embodiment, inflation device 19 is configured to control the inflation rate of helmet airbag assembly 16 based on at least one of the expected impact parameters and the actual impact parameters measured by sensor 40. Sensor 40 may be positioned about the exterior of helmet 12 to be capable of sensing impact parameters from various directions. In some embodiments, sensors 40 are positioned beneath an exterior shell of helmet 12.

Figure 5:
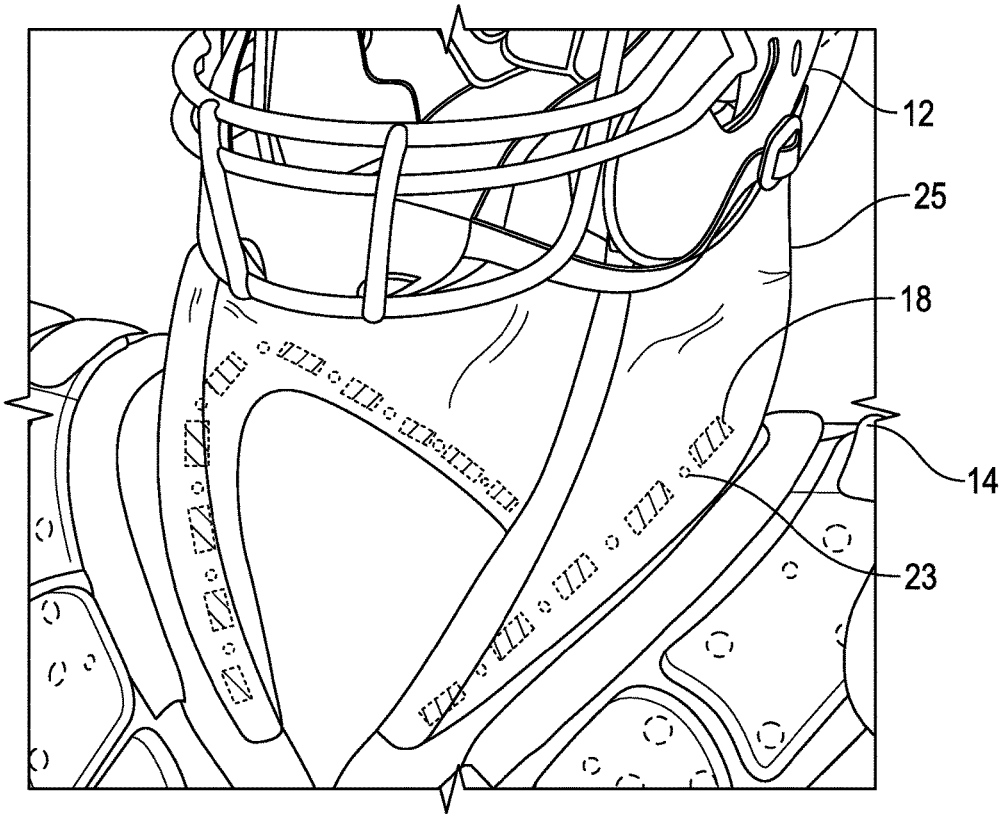
FIG. 5 is a detailed view of an active connection between a helmet and a torso protection assembly according to one embodiment.

Referring now to FIG. 5, a detailed view of the active connection of helmet airbag assembly 16 is shown according to one embodiment. The active coupling between torso protection assembly connector 18 and airbag connector 23 is configured to couple helmet 12 to torso protection assembly 14 in relative positions upon inflation of helmet airbag assembly 16 based on the relative positions of airbag connector 23 and torso protection assembly connector 18 at the time of their contact to prevent any rapid twisting or other movement of the neck. Connectors 18 and 23 may each include a single or multiple connector elements (e.g., magnets, mechanical couplings, hook and loop fastener devices, adhesive components, etc.) extending partially or fully around the user's head and neck to form one or more coupling joints between connections 18, 23 or local coupling elements of connectors 18, 23. Local coupling elements on connectors 18 and 23 are configured to independently couple together upon contact, regardless of the overall alignment of the full connectors 18 and 23 and/or helmet 12 and torso protection assembly 14. Accordingly, connectors 18 and 23 are configured to couple together despite misalignments between them (due, for instance, to the rotation or tilting of helmet 12 relative to torso protection assembly 14). The coupling between the two connectors in one embodiment may form a single coupling joint configured to fail upon application of a predetermined load (e.g., force or torque) to the coupling joint to aid in the dissipation of impact energy. The connectors may, in other embodiments, form a plurality of coupling joints where each coupling joint is configured to fail upon application of a different load to its respective coupling joint.

For example, in some embodiments, airbag connector 23 and torso protection assembly connector 18 both include one or more magnets configured to secure helmet 12 and torso protection assembly 14 together by way of a magnetic force. A series of magnets may extend partially or entirely around a circumference of a lower portion of airbag 25, and a corresponding number of magnets may extend partially or entirely around an upper portion of torso protection assembly 14. Upon contact, the magnets actively couple helmet 12 and torso protection assembly 14 in relative positions (e.g., the relative positions of the helmet and torso protection assembly at the time of (or just prior to) impact) to resist further relative movement.

In another embodiment, airbag connector 23 and torso protection assembly connector 18 both include one or more hook and loop fasteners configured to secure helmet 12 and torso protection assembly 14 together by way of a mechanical connection. Typically, the opposing surfaces to be fastened have differing connection strips, either hook connectors or loop connectors. When the two components are actively connected, the hooks catch in the loops and fasten the components together. A series of hook and loop fasteners may extend partially or entirely around a circumference of a lower portion of airbag 25, and a corresponding series of hook and loop fasteners may extend partially or entirely around an upper portion of torso protection assembly 14. Upon contact, the hook and loop fasteners actively couple helmet 12 and torso protection assembly 14 in relative positions to resist further relative movement.

In further embodiments, airbag connector 23 and torso protection assembly connector 18 may combine to secure helmet 12 and torso protection assembly 14 together by way of a connection through quick drying adhesives. When airbag 25 is deployed or inflated, adhesive components may be extruded from the surface, or may be exposed (e.g., by removing a protective covering) and extend partially or entirely around a circumference of a lower portion of airbag 25. The adhesive components may also be extruded from one or both components. Upon contact, the adhesive components actively couple helmet 12 and torso protection assembly 14 in relative positions to resist further relative movement. In some embodiments, the adhesive may be formed at the time of contact by the reaction of two separate components, one of which is disposed on connector 18 and the other on connector 23. In some embodiments, adhesives having varying strengths may be used about one or both of helmet 12 and torso protection assembly 14 to provide multiple joints of varying strength.

In some embodiments, one or both of connectors 18 and 23 may be configured to have one or more portions fail at predetermined threshold levels, thereby absorbing a portion of the energy involved in an impact. For example, one or both of connectors 18 and 23 may include components configured to fail (e.g., break, rupture, tear, etc.) at a predetermined torque level, a predetermined force level (e.g., a tensile force, a shear force, etc.), etc. In embodiments where multiple connector components are utilized, individual portions of connector 18 and/or 23 may be configured with varying failure strengths, such that the portions fail at varying threshold levels of torque, force, etc.

For example, in some embodiments connectors 18 and 23 include magnets configured to form a coupling joint capable of withstanding a certain predetermined force or torque. Once the predetermined force or torque is reached or exceeded, the coupling joint fails, such that the parts are decoupled. As noted above, multiple magnetic coupling joints may be formed, with varying degrees of force or torque being required to decouple each of the joints. Other types of connector components (e.g., adhesives, mechanical couplings, hook and loop fasteners, etc.) may be configured in a similar fashion to provide for joint failure and energy absorption during and after impact.

Figure 6:
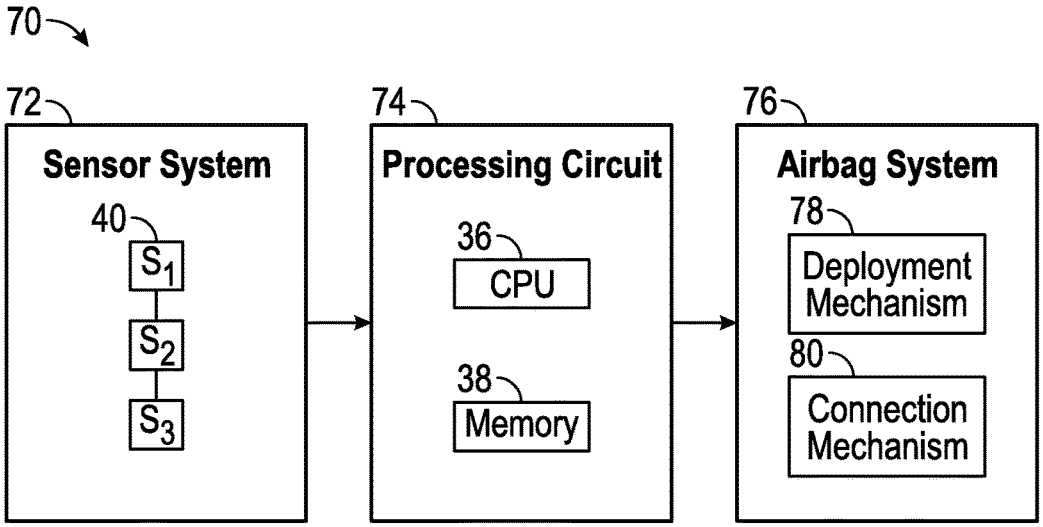
FIG. 6 is a block diagram of a control system for an airbag deployment system according to one embodiment.

Referring now to FIG. 6, control system 70 for controlling operation of airbag deployment system 10 is shown according to one embodiment. Control system 70 includes sensor system 72, processing circuit 74, and airbag system 76. Sensor system 72 may be one or more devices (e.g., sensors, micropower impulse radar, ultrasound sonar, accelerometers, pressure sensors, strain sensors, etc.) that acquire expected impact data and actual impact data that may then be relayed to processing circuit 74. In one embodiment, sensor system 72, processing circuit 74, and airbag system 76 are integrated into helmet 12. In other embodiments, all or a portion of processing circuit 74 is located remotely from and in communication with sensor system 72 and airbag system 76.

Processing circuit 74 is configured to control operation of airbag system 76. In one embodiment, processing circuit 74 controls operation of airbag system 76 based on sensor data from sensor system 72 and/or other inputs and data. For example, in some embodiments, stored data in memory 38 and measured data from sensor 40 may be compared to determine an impact parameter threshold (e.g., a user defined threshold) has been reached. If so, processor 36 inflates helmet airbag assembly 16. Processor 36 controls the inflation of the airbag assembly through inflation device 19, leading to the connection of helmet 12 and torso protection assembly 14.

In one embodiment, processing circuit 74 includes processor 36 and memory 38. Processor 36 may be implemented as a general-purpose processor, an application specific integrated circuit (ASIC), one or more field programmable gate arrays (FPGAs), a digital-signal-processor (DSP), a group of processing components, or other suitable electronic processing components. Memory 38 is one or more devices (e.g., RAM, ROM, Flash Memory, hard disk storage, etc.) for storing data and/or computer code for facilitating the various processes described herein. Memory 38 may be or include non-transient volatile memory or non-volatile memory. Memory 38 may include database components, object code components, script components, or any other type of information structure for supporting the various activities and information structures described herein. Memory 38 may be communicably connected to processor 36 and provide computer code or instructions to processor 36 for executing the processes described herein.

In one embodiment, helmet airbag assembly 16 may be triggered based on at least one of sensor data from sensor system 72 and a manual user input (i.e., self-triggered). The sensor data may indicate at least one of a potential impact and an actual impact. Helmet airbag assembly 16 may be triggered (i.e., inflating airbag 25) by processor 36 through the activation of inflation device 19 based on sensor data exceeding a predetermined threshold (e.g., threshold data stored in memory 38). The predetermined threshold may be set by a user and/or based on or set using other factors (e.g., known player size, etc.). Airbag 25 may be deployed from the underside of helmet 12 toward torso protection assembly 14. Airbag 25 may also be deployed about a portion of the user's neck including about the side of the user's neck and/or about the posterior portions of the user's neck. In another embodiment, an airbag may also be deployed from face mask 13 about the front portion of the user's neck. In one embodiment, processing circuit 74 is configured to inflate the airbag assembly prior to impact based on expected impact data such as time to impact, relative velocity, predicted impact strength or location, etc. In other embodiments, processing circuit 74 is configured to inflate the airbag assembly after impact based on actual impact data. As noted elsewhere herein, processing circuit 74 may further base inflation of the airbag assembly on other factors, such as player characteristics (e.g., height, weight, current speed or direction, etc.), pre-defined parameters (e.g., location on a playing field, location on street etc.), and the like.

Figure 7:
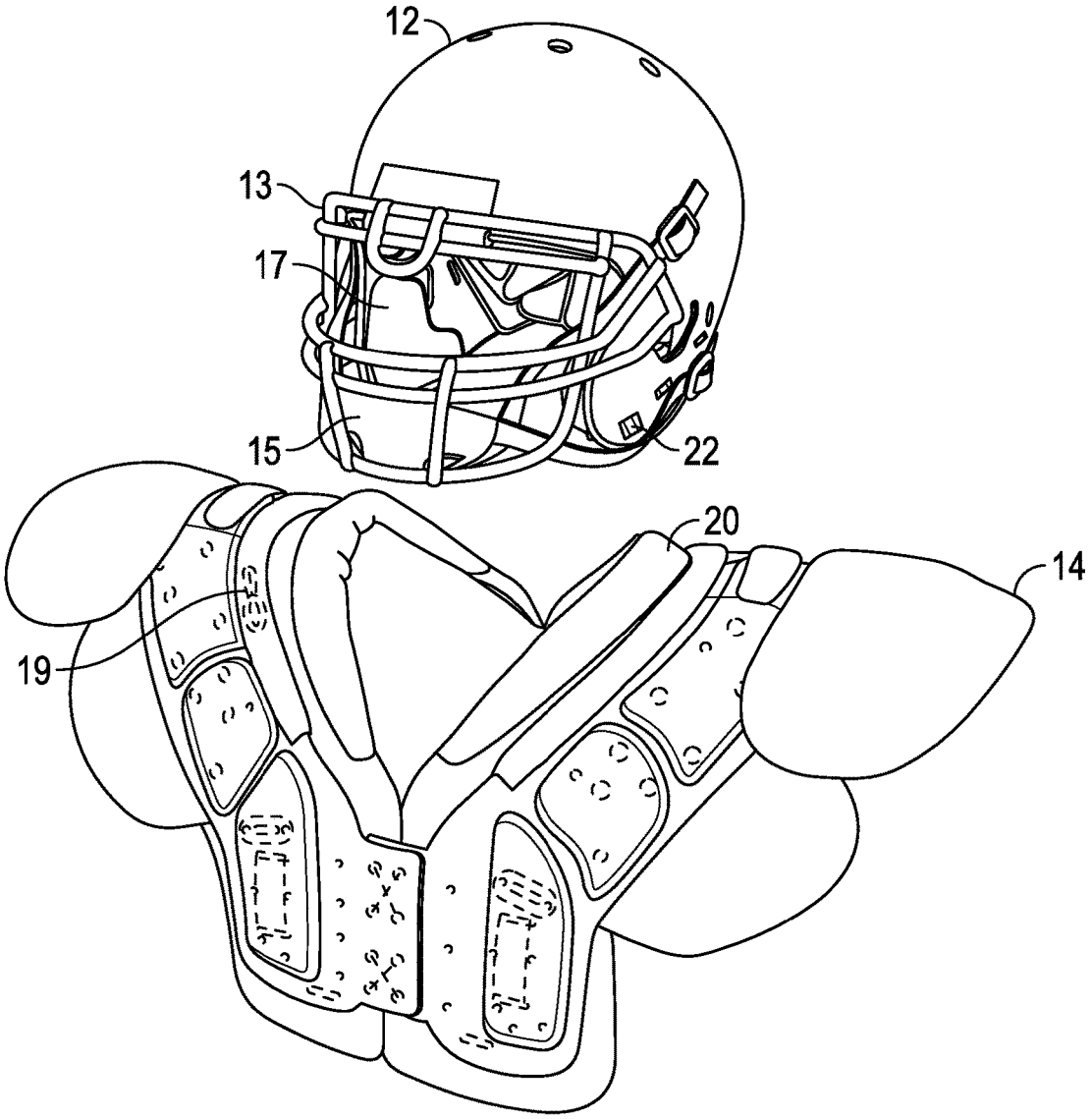
FIG. 7 is a perspective view of a helmet and torso protection assembly embodying an airbag assembly prior to airbag deployment according to another embodiment.

Referring now to FIGS. 7-10, airbag deployment system 10 is shown according to another embodiment. Referring to FIG. 7, helmet 12 includes facemask 13, chin strap 15, helmet padding 17, and helmet connector 22 (e.g., a coupling device). Torso protection assembly 14 includes inflation device 19 configured to inflate torso protection airbag assembly 20 by means of a chemical reaction to produce gas, or alternatively may involve the storage and release of compressed gas. Helmet connector 22 is one or more coupling devices (e.g., hook and loop fasteners, magnets, quick drying adhesive, etc.) embedded in or coupled to the lower portion of helmet 12 for coupling helmet 12 and torso protection assembly 14 by means of torso protection airbag assembly 20. The configuration of FIGS. 7-10 differs from that of FIGS. 2-5 in that the airbag assembly of FIGS. 7-10 is deployed from the torso protection assembly rather than the helmet.

Figure 8:
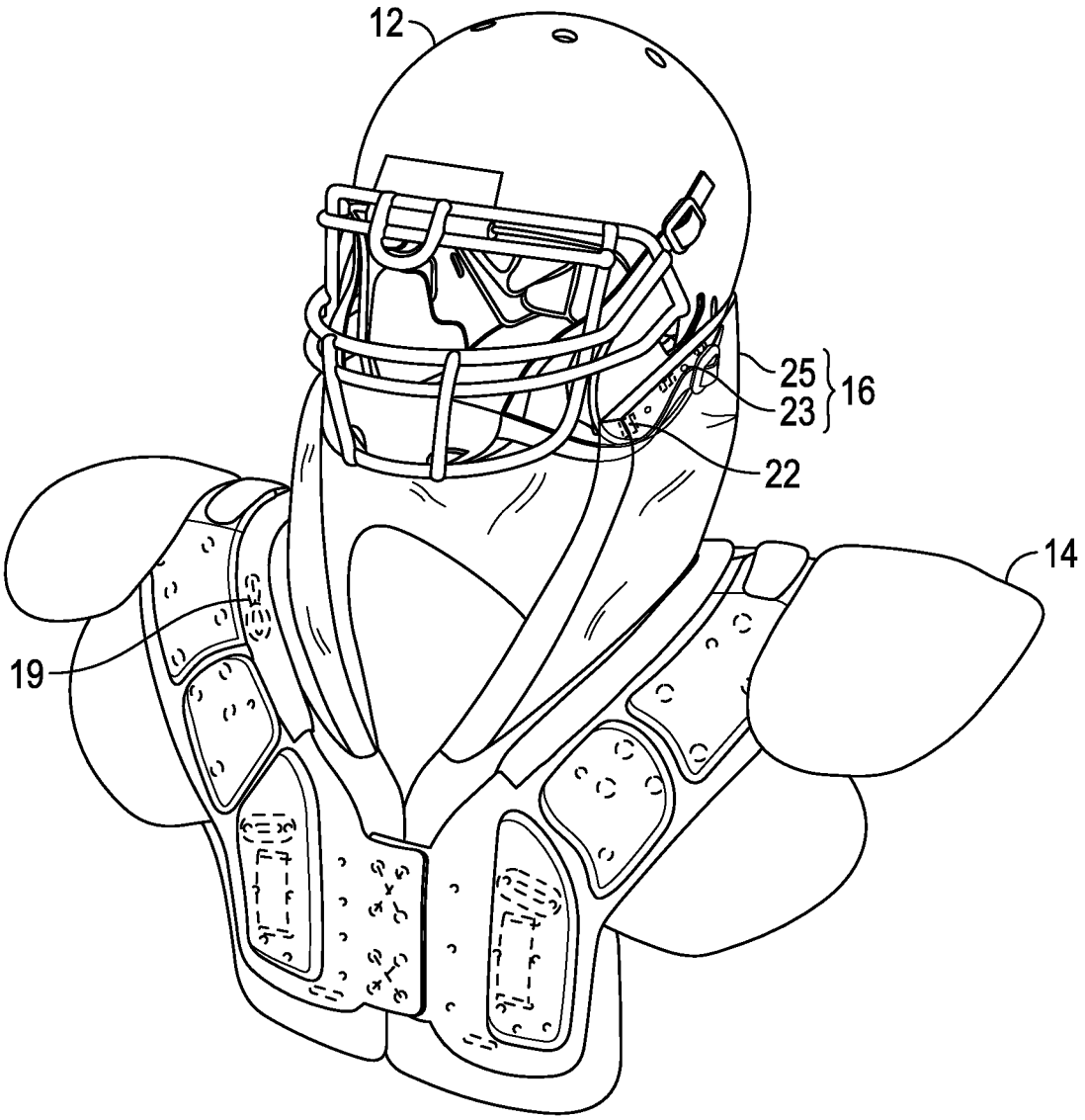
FIG. 8 is a perspective view of the helmet and torso protection assembly of FIG. 7 after airbag deployment from the torso protection assembly and connection to the helmet according to another embodiment.

Referring to FIG. 8, the active coupling between helmet 12 and torso protection assembly 14 is shown for another embodiment. Torso protection airbag assembly 20 includes airbag 25 and airbag connector 23. Airbag connector 23 may be one or more coupling devices which actively couple to helmet connector 22 to resist relative movement between helmet 12 and torso protection assembly 14 to reduce risk of injury to the user of system 10.

Figure 9:
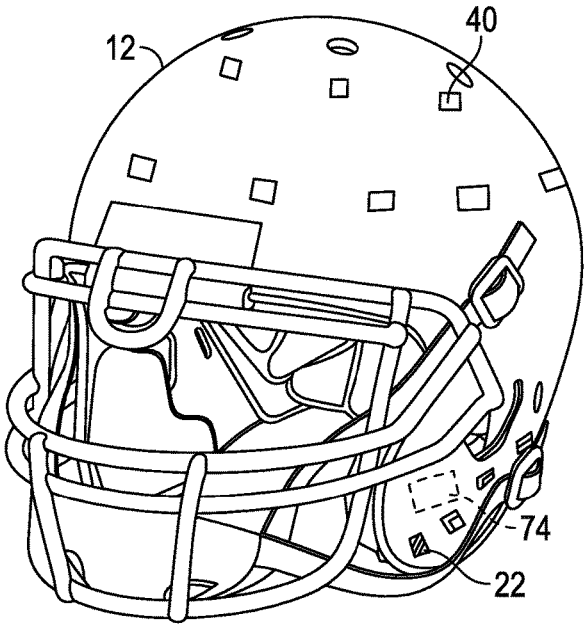
FIG. 9 is a perspective view of a helmet usable with a personal protection system and a torso protection assembly according to another embodiment.

Referring to FIG. 9, another embodiment of helmet 12 is shown. The configuration of helmet 12 includes processor 36, memory 38, sensor 40, and helmet connector 22. In one embodiment, sensor 40 is implemented as a micropower impulse radar (MIR). In another embodiment, sensor 40 may be one or more devices configured to measure at least one of an expected time until an impact, a speed of an impacting body, the size of an impacting body, and a distance between impacting bodies to define expected impact parameters. In other embodiments, sensor 40 is configured to measure at least one of a force, a torque, and an acceleration (e.g., of the helmet during impact, of an approaching object or person before or during impact, relative acceleration(s), etc.) to define actual impact parameters.

Figure 10:
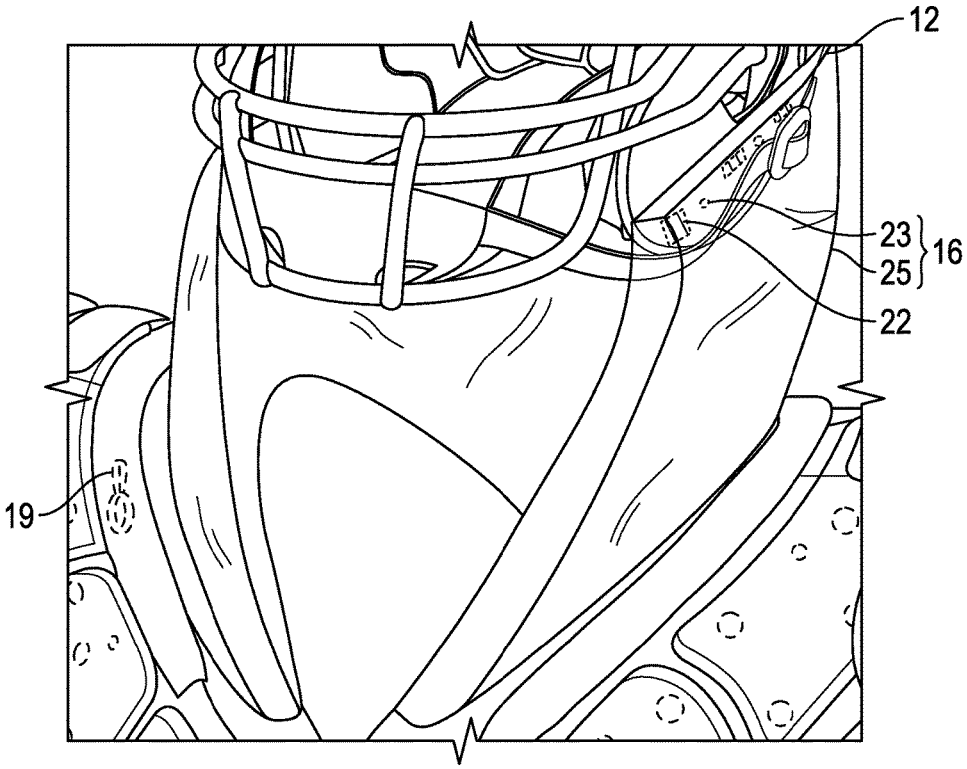
FIG. 10 is a detailed view of an active connection between a helmet and a torso protection assembly according to another embodiment.

Referring now to FIG. 10, a detailed view of the active connection of torso protection airbag assembly 20 is shown according to another embodiment. Inflation device 19 is configured to control the inflation rate of torso protection airbag assembly 20 based on at least one of the expected impact parameters and the actual impact parameters measured by sensor 40. The active coupling between helmet connector 22 and airbag connector 23 is configured to couple helmet 12 to torso protection assembly 14 in relative positions upon inflation of torso protection airbag assembly 20 based on the relative positions of helmet connector 22 and airbag connector 23 at the time of their contact to prevent any rapid twisting or other movement of the neck. Connectors 22 and 23 may each include a single or multiple connector elements (e.g., magnets, mechanical couplings, hook and loop fastener devices, adhesive components, etc.) extending partially or fully around the user's head and neck. The coupling between the two connectors in the embodiment may form a single coupling joint configured to fail upon application of a predetermined force to the coupling joint to aid in the dissipation of impact energy. The connectors may however form a plurality of coupling joints where each coupling joint is configured to fail upon application of a different force to its respective coupling joint. The configuration shown in FIGS. 7-10 may share any of the features described with respect to the embodiment of FIGS. 1-6. In some embodiments, both helmet 12 and torso protection assembly 14 can include airbags, both of which are inflated and couple together upon contact via respective connectors 23 and 22.

Figure 11:
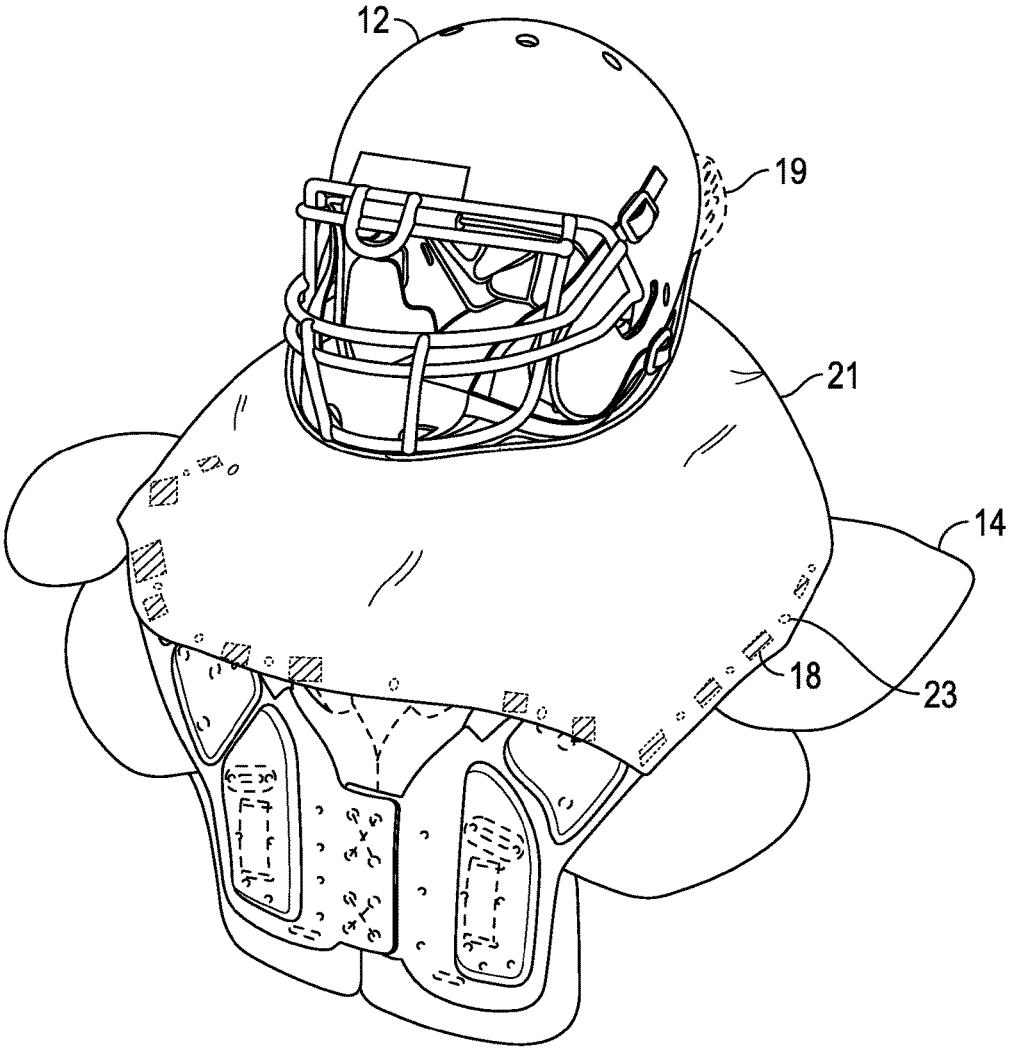
FIG. 11 is a perspective view of a helmet embodying an extended airbag assembly and a torso protection assembly after airbag deployment according to another embodiment.

In yet another embodiment, as shown in FIG. 11, the active coupling between helmet 12 and torso protection assembly 14 may configure to extend at least partially over the user's collarbone and encircle the user's entire neck when inflated. System 10, in this particular embodiment, may operate in a similar manner to that discussed with respect to FIGS. 1-10, and included any of the associated features. For example, the airbag assembly may deploy from the helmet or the torso protection assembly (or both) and may include one or more joints configured to fail at varying threshold levels.

Figure 12:
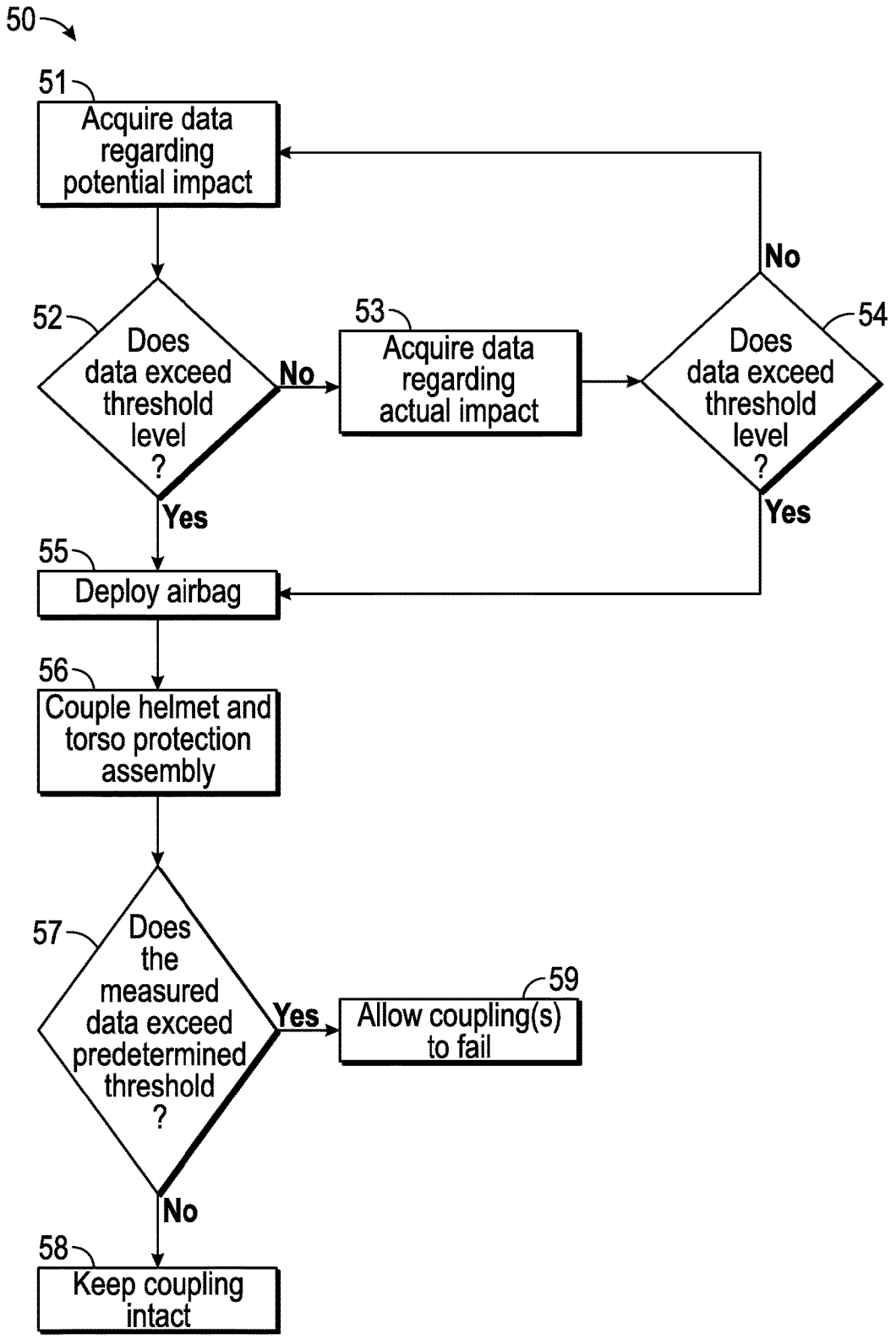
FIG. 12 is a block diagram illustrating a method of operating an airbag deployment system according to one embodiment.

FIG. 12 shows a flow chart of process 50 of using airbag deployment system 10. Process 50 includes initially acquiring data regarding the characteristics of a potential impact (51). For example, one or more sensors may acquire data regarding the relative position, velocity, acceleration, etc. between a first airbag deployment system 10 and an impacting object (e.g., a second airbag deployment system, a person, an inanimate object, etc.). The potential impact data is analyzed (52). For example, processor 36 may compare user inputted unsafe impact parameters stored in memory 38 to the acquired data from the potential impact. The system then either inflates the airbag (55) or waits to acquire additional data. For example, in some embodiments, if the data exceeds predetermined levels (e.g., impact threshold levels) for the user, the system inflates the airbag to protect the user. If the data does not exceed the predetermined levels for the user, the system does not inflate the airbag until after actual impact data may be analyzed. If the airbag is inflated, helmet 12 and torso protection assembly 14 are coupled (56). If the airbag is not inflated, additional data is acquired regarding an actual impact (53). For example, one or more sensors may acquire data regarding at least one of a force, a torque, and an acceleration from two or more different bodies colliding. Then, the actual impact data may be analyzed (54). For example, processor 36 may compare user-provided impact parameters stored in memory 38 to the acquired data from the actual impact. If the data does not exceed the predetermined threshold, steps 50-54 may be repeated. However, if the data exceeds the predetermined threshold, steps 55 and 56, mentioned above, may be completed.

After coupling helmet 12 and torso protection assembly 14, additional data is analyzed regarding user defined thresholds (57). For example, the user may store data in memory 38 which processor 36 may access to determine if the impact is of sufficient magnitude to require the decoupling of the joint(s). The coupling between two connectors may form a single coupling joint configured to fail upon application of a predetermined load to the coupling joint to aid in the dissipation of impact energy. The connectors may however form a plurality of coupling joints where each coupling joint is configured to fail upon application of a different load to its respective coupling joint. If a threshold is not exceeded, the coupling may remain intact (58). If a threshold is in fact exceeded, all or individual joints may be allowed to fail (59) in order to better dissipate impact energy. For example, if the active coupling of a joint is provided through the implementation of magnets, an individual joint may be designed to withstand a certain impact. This impact threshold may be different for the various locations around the user's neck. Thus, different strength magnets (or, similarly, fasteners, adhesives, etc.) may be implemented for the various joints to allow for the decoupling of an individual joint which encounters an impact exceeding its respective design strength.

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An airbag deployment system, comprising:

a torso protection assembly; and an airbag assembly coupled to the torso protection assembly, the airbag assembly including:

an airbag;

an inflation device configured to inflate the airbag from a deflated configuration to an inflated configuration; and an airbag coupling device provided on the airbag, the airbag coupling device positioned to couple with a helmet coupling device provided on a helmet following inflation of the airbag from the deflated configuration into the inflated configuration such that the airbag resists relative movement between the helmet and the torso protection assembly.

2. The system of claim 1, wherein the airbag coupling device includes at least one of an adhesive, a magnet, and a hook and loop fastener.

3. The system of claim 1, wherein the airbag is configured to extend about posterior and side portions of a user's neck when inflated.

4. The system of claim 1, wherein the airbag is configured to extend about an entire circumference of a user's neck when inflated.

5. The system of claim 1, wherein the airbag coupling device is configured to couple to the helmet coupling device to couple the helmet to the torso protection assembly in relative positions upon inflation of the airbag based on the relative positions of the helmet and the torso protection assembly at a time of contact between the airbag coupling device and the helmet coupling device.

6. The system of claim 1, wherein the inflation device is configured to inflate the airbag based on an impact experienced by at least one of the helmet and the torso protection assembly.

7. The system of claim 1, wherein the inflation device is configured to inflate the airbag based on an impact parameter of an impact exceeding a predetermined threshold.

8. The system of claim 7, wherein the impact parameter includes at least one of a force, a torque, and an acceleration.

9. The system of claim 1, wherein the inflation device is configured to inflate the airbag based on an expected impact to at least one of the helmet and the torso protection assembly.

10. The system of claim 1, wherein the inflation device is configured to control an inflation rate of the airbag based on an impact parameter.

11. The system of claim 10, wherein the impact parameter includes at least one of an expected time until an impact, a speed of an impacting body, a size of an impacting body, and a distance between impacting bodies.

12. The system of claim 1, wherein the airbag coupling device and the helmet coupling device cooperatively form a coupling joint configured to fail upon application of at least one of a predetermined force to the coupling joint and a predetermined torque to the coupling joint.

13. The system of claim 1, wherein the airbag coupling device and the helmet coupling device cooperatively form a plurality of coupling joints, wherein each of the plurality of coupling joints is configured to fail upon application of a different predetermined force to the coupling joint.

14. The system of claim 1, further comprising a processing circuit configured to control inflation of the airbag via the inflation device.

15. The system of claim 14, wherein the processing circuit is configured to control inflation of the airbag based on a user input.

16. The system of claim 15, wherein the user input is an impact parameter threshold.

17. The system of claim 1, wherein the helmet is a sports helmet and the torso protection assembly is a shoulder pad assembly.

18. The system of claim 1, wherein the inflation device includes compressed gas storage configured to store compressed gas that facilitates inflating the airbag with the compressed gas.

19. The system of claim 1, wherein the inflation device includes chemical storage configured to store chemicals that interact to produce gas to inflate the airbag.

20. An airbag deployment system, comprising:

an airbag assembly configured to couple to a torso protection assembly, the airbag assembly including:

an airbag;

an inflation device configured to inflate the airbag from a deflated configuration to an inflated configuration; and an airbag coupling device provided on the airbag, the airbag coupling device positioned to couple with a helmet coupling device provided on a helmet following inflation of the airbag from the deflated configuration into the inflated configuration such that the airbag couples the torso protection assembly to the helmet.

21. The system of claim 20, wherein the airbag is configured to extend about posterior and side portions of a user's neck when inflated.

22. The system of claim 20, wherein the airbag is configured to extend about an entire circumference of a user's neck when inflated.

23. The system of claim 20, wherein the airbag coupling device includes at least one of an adhesive, a magnet, and a hook and loop fastener.

24. The system of claim 20, wherein the inflation device is configured to inflate the airbag based on an impact experienced by at least one of the helmet and the torso protection assembly.

25. The system of claim 20, wherein the inflation device is configured to inflate the airbag based on an expected impact to at least one of the helmet and the torso protection assembly.

26. The system of claim 20, wherein the inflation device is configured to control an inflation rate of the airbag based on an impact parameter.

27. The system of claim 26, wherein the impact parameter includes at least one of an expected time until an impact, a speed of an impacting body, a size of an impacting body, and a distance between impacting bodies.

28. The system of claim 20, wherein the inflation device includes compressed gas storage configured to store compressed gas that facilitates inflating the airbag with the compressed gas.

29. The system of claim 20, wherein the inflation device includes chemical storage configured to store chemicals that interact to produce gas to inflate the airbag.

30. An airbag deployment system, comprising:

a torso protection assembly; and an airbag coupled to the torso protection assembly, the airbag selectively inflatable from a deflated configuration to an inflated configuration;

wherein the airbag selectively deploys from the torso protection assembly toward a helmet to selectively couple the torso protection assembly to the helmet following inflation of the airbag from the deflated configuration into the inflated configuration.

31. The system of claim 30, wherein the airbag is configured to extend about posterior and side portions of a user's neck when inflated.

32. The system of claim 30, wherein the airbag is configured to extend about an entire circumference of a user's neck when inflated.

33. The system of claim 30, further comprising an inflation device configured to inflate the airbag from the deflated configuration to the inflated configuration.

34. The system of claim 30, wherein the airbag resists relative movement between the helmet and the torso protection assembly.

35. The system of claim 30, further comprising a coupling device provided on the airbag, the coupling device positioned to interface with a corresponding coupling device provided on the helmet to couple the airbag to the helmet when in the inflated configuration.

* * * * *